US011953286B1

(12) United States Patent
Enderle et al.

(10) Patent No.: US 11,953,286 B1
(45) Date of Patent: Apr. 9, 2024

(54) RAPID FIRE TOY LAUNCH APPARATUS

(71) Applicant: Hasbro, Inc., Pawtucket, RI (US)

(72) Inventors: Alyssa Enderle, Providence, RI (US); James Edward Brown, Jr., Pawtucket, RI (US)

(73) Assignee: Hasbro, Inc., Pawtucket, RI (US)

( * ) Notice: Subject to any disclaimer, the term of this patent is extended or adjusted under 35 U.S.C. 154(b) by 17 days.

(21) Appl. No.: 17/856,858

(22) Filed: Jul. 1, 2022

Related U.S. Application Data

(60) Provisional application No. 63/220,187, filed on Jul. 9, 2021.

(51) Int. Cl.

| | |
|---|---|
| ***F41A 17/48*** | (2006.01) |
| ***F41A 19/10*** | (2006.01) |
| ***F41B 7/00*** | (2006.01) |
| ***F41B 7/08*** | (2006.01) |
| *F41B 11/50* | (2013.01) |
| *F41B 11/89* | (2013.01) |

(52) U.S. Cl.
CPC ..... *F41B 7/006* (2013.01); *F41A 17/48* (2013.01); *F41A 19/10* (2013.01); *F41B 7/003* (2013.01); *F41B 7/08* (2013.01); *F41B 11/50* (2013.01); *F41B 11/89* (2013.01)

(58) Field of Classification Search
CPC .. F41B 7/006; F41B 7/003; F41B 7/08; F41B 11/50; F41B 11/55; F41B 11/57; F41B 11/71; F41B 11/89; F41B 4/00; F41A 17/48; F41A 19/10
See application file for complete search history.

(56) References Cited

U.S. PATENT DOCUMENTS

| | | | | | |
|---|---|---|---|---|---|
| 46,617 | A | | 3/1865 | Allen | |
| 159,609 | A | | 2/1875 | Prescott | |
| 956,760 | A | | 5/1910 | Moulin | |
| 1,205,166 | A | * | 11/1916 | Dettra | F41B 7/08 124/39 |
| 1,441,975 | A | | 1/1923 | Edelin | |
| 1,488,995 | A | | 4/1924 | McCollom | |
| 2,737,942 | A | | 3/1956 | Horowitz et al. | |
| 3,054,536 | A | | 9/1962 | Sagarin | |
| 3,262,440 | A | | 7/1966 | Kuhn | |
| 3,348,531 | A | * | 10/1967 | Yano | F41B 7/006 124/37 |
| 3,420,133 | A | | 1/1969 | Proll | |
| 3,990,426 | A | | 11/1976 | Stokes | |

(Continued)

*Primary Examiner* — John E Simms, Jr.
(74) *Attorney, Agent, or Firm* — Perry Hoffman

(57) ABSTRACT

Apparatus and methods employing dual triggered feeding of projectiles from plural or multiple magazine clips with multiple interlock features in a rapid fire toy launcher employing a clips carriage mounted for translatable movement using a carriage selector separately positions clips in line for individual projectile feeding and launch. A propelling mechanism receives projectiles from an elongated projectile checking subassembly using a reversible projectile advancing feeder with a gear combination that advances and returns a pusher extension for feeding projectiles through the clips carriage upper portion. The reversible projectile advancing feeder is positioned in the housing forward the inserted magazine clips. Triggers including a propelling mechanism trigger activates a key and a fire key is activated with a fire trigger.

18 Claims, 9 Drawing Sheets

(56) References Cited

U.S. PATENT DOCUMENTS 4,241,716 A * 12/1980 Tsui ..... F41B 7/006 124/39
4,597,527 A 7/1986 Sands
4,774,929 A 10/1988 Millman
4,841,945 A 6/1989 Braden
4,890,404 A 1/1990 Ferri
5,205,271 A 4/1993 Salva
5,244,153 A 9/1993 Kuhn et al.
5,267,549 A 12/1993 Webber
5,343,850 A 9/1994 Steer
5,471,967 A 12/1995 Matsuzaki et al.
5,529,050 A 6/1996 D'Andrade
5,535,729 A 7/1996 Griffin et al.
5,704,150 A 1/1998 Millman
5,878,734 A 3/1999 Johnson et al.
6,119,671 A 9/2000 Smith et al.
6,488,019 B2 12/2002 Kotsiopoulos
7,051,727 B2 5/2006 Wu
8,082,909 B2 12/2011 Sopinsky et al.
8,113,188 B2 2/2012 Ma
8,127,753 B1 3/2012 Brooks et al.
8,127,754 B1 3/2012 Johnson et al.
8,336,531 B2 12/2012 Fan et al.
8,397,705 B2 3/2013 DeHaan et al.
8,567,378 B2 10/2013 Nugent
8,695,579 B2 4/2014 Huebl
8,875,688 B2 11/2014 Nugent
9,097,476 B2 8/2015 Mead et al.
9,097,477 B1 8/2015 Mead et al.
9,389,042 B1 7/2016 Clayton
9,500,436 B2 11/2016 Macy
9,958,230 B1 * 5/2018 Nugent ..... F41A 9/65
10,488,143 B2 * 11/2019 Victor ..... A63F 9/0252
10,488,148 B2 11/2019 Johnson et al.
10,823,527 B2 11/2020 Tino et al.
10,859,337 B1 * 12/2020 Bernal ..... F41B 7/08
10,876,809 B1 * 12/2020 Kopman ..... F41B 4/00
10,907,929 B2 2/2021 Bernal
2002/0166551 A1 * 11/2002 Lee ..... F41B 4/00 124/78
2009/0095272 A1 * 4/2009 Zimmerman ..... F41B 4/00 124/78
2010/0206281 A1 8/2010 Kanitz et al.
2011/0283984 A1 * 11/2011 Hu ..... F41B 11/642 124/77
2013/0112184 A1 5/2013 Corsiglia et al.
2013/0312722 A1 11/2013 Price
2015/0176942 A1 * 6/2015 Hu ..... F41B 11/57 124/32
2015/0241164 A1 * 8/2015 Hsu ..... F41B 11/51 124/51.1
2016/0018184 A1 1/2016 Park
2019/0063865 A1 * 2/2019 Victor ..... F41A 9/83
2019/0113303 A1 * 4/2019 Johnson ..... F41B 11/55

* cited by examiner

RAPID FIRE TOY LAUNCH APPARATUS

PRIORITY CROSS-REFERENCE TO RELATED APPLICATIONS

This application claims priority pursuant to 35 U.S.C. 119(e) from U.S. Provisional Patent Application No. 63/220,187 filed on Jul. 9, 2021.

1. FIELD OF THE INVENTION

The present invention relates to toy projectile launchers and more particularly, to a rapid fire toy launch apparatus employing projectile feeding magazines, loading and launching mechanisms which may include improvised projectile (IP) detection features facilitating repeating automatic launch sequenced operations, based on the combination of several keys ensuring rapid fire IP checking subassembly orientation with proper conditions, otherwise disabling the propelling mechanism after predetermined period of time expirations.

2. BACKGROUND OF THE INVENTION

Projectile launcher mechanisms are known in the art and include mechanisms for launching toy darts, balls of various sizes, paint balls, etc., and even paper money. Some known methods/mechanisms for feeding darts into a drive or fly wheel or other energized launching mechanism, include advancing mechanisms actively pushing darts or projectiles into an energized launching mechanism or, alternatively, mechanisms which remove physical barriers from a path or channel leading to a launching mechanism. Various toy launchers/guns known in the art employ a projectile shooting mechanism made up of two opposed rotatable wheels, known as a drive or fly wheels, which engage a dart or other various balls and projectiles there between. Other known feeding mechanisms employ rods, pistons or hammers which actively push darts into an adjacent launching mechanism.

Feeding mechanisms are further known to include an elongated arm biased into contact with a stack of darts lined up adjacent a drive wheel. The arm is biased into contact with the upper most dart of the stack and urges the lower most dart into the barrel adjacent the drive wheel. A biased trigger and hammer arrangement push the dart through the barrel and into the drive wheel for firing the dart when the trigger is pulled. Other known feeding mechanisms remove physical barriers from a path leading to a launching mechanism and are known to include a biased trigger, that when depressed, removes a barrier and allows a dart or projectile to enter a launch channel for engagement with rotating flywheels or drive wheels to project the dart. Also known is a trigger lever which rotates when pulled, translating into movement of a motorized pusher to advance faster than the trigger can activate in a reciprocating manner for rapid firing.

The contents of Applicants' Assignees' U.S. Pat. No. 10,876,809 to Kopman, et al. for "Quick start projectile launcher and methods" illustrates and describes, in detail, toy launcher synchronized drive mechanisms for advancing rotation of projectile-propelling flywheels with movements for automatic and sequenced projectile-launching pusher operation to auto-fire using a trigger switch circuit engaged to run its motor and maintain flywheel rotation engaged until the trigger is released, and is incorporated into the presented disclosure by reference in its entirety. The contents of Applicants' Assignees' U.S. Pat. No. 10,488,143 to Victor, et al. for "Rapid Fire Toy Launch Apparatus" illustrates and describes, in detail, toy launcher projectile feeding magazine storage apparatus and rapid fire toy launch methods receiving a series of projectiles with its launching mechanism positioned in the housing forward an inserted magazine, and is incorporated into the presented disclosure by reference in its entirety.

Significantly, known toy launchers do not include plural or multiple magazine clips with dual triggered feeding of projectiles employing multiple interlock features enabled to receive projectiles based on a combination of several keys including a propelling mechanism trigger key and a fire key activated with a fire trigger to operate the projectile propelling mechanism firing operations through a mounted clips carriage with translatable movement using a carriage selector separately positioning clips in line for individual projectile launching. Further, known rapid fire launchers do not include propelling mechanisms enabled to receive projectiles based on the combination of several keys, with the Home key at the proximal end of an elongated projectile checking subassembly indicating the gear combination orientation with proper conditions, otherwise disabling the propelling mechanism after predetermined period of time expirations. It would be further desirable to facilitated propelling mechanisms enabled so as to receive projectiles facilitating repeating automatic launch sequenced operations, based on the combination of several keys ensuring rapid fire checking subassembly orientation with proper conditions.

SUMMARY OF THE INVENTION

The present invention addresses shortcomings of the prior art to provide a toy launch apparatus and methods employing dual triggered feeding of projectiles from plural or multiple magazine clips with multiple interlock features in a rapid fire toy launcher employing a clips carriage mounted for translatable movement using a carriage selector separately positions clips in line for individual projectile feeding and launch. A propelling mechanism is enabled to receive projectiles based on a combination of several keys including a propelling mechanism trigger activates a key and a fire key is activated with a fire trigger.

In certain embodiments a motorized Flywheels assembly and the propelling mechanism key may be provided as a first electrical switch activated by the proximal extension of the propelling mechanism trigger. The reversible projectile advancing feeder may be provided as a reversible feeder motor and the Fire key may be provided as a second electrical switch activated by the proximal extension of the elongated Fire trigger. The Home key may be provided as a third electrical switch activated by the reversible projectile advancing feeder with the gear combination orientation at the Home position. The projectile Detect key may be provided as a fourth electrical switch activated by the projectile lock at the catch latch recess. Disclosed embodiments may further employ an information processor logic element that takes the first, second, third and fourth electrical switches as inputs to operate the Feeder Motor for firing operations of projectiles. Briefly summarized the propelling mechanism may be enabled to receive projectiles based on the combination of several keys, with the Home key verifying gear combination orientation with proper conditions, otherwise disabling the propelling mechanism after predetermined period of time expirations.

BRIEF DESCRIPTION OF THE DRAWINGS

For the purpose of facilitating an understanding of the inventions, the accompanying drawings and description illustrate preferred embodiments thereof, from which the inventions, structure, construction and operation, and many related advantages may be readily understood and appreciated.

DETAILED DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1:
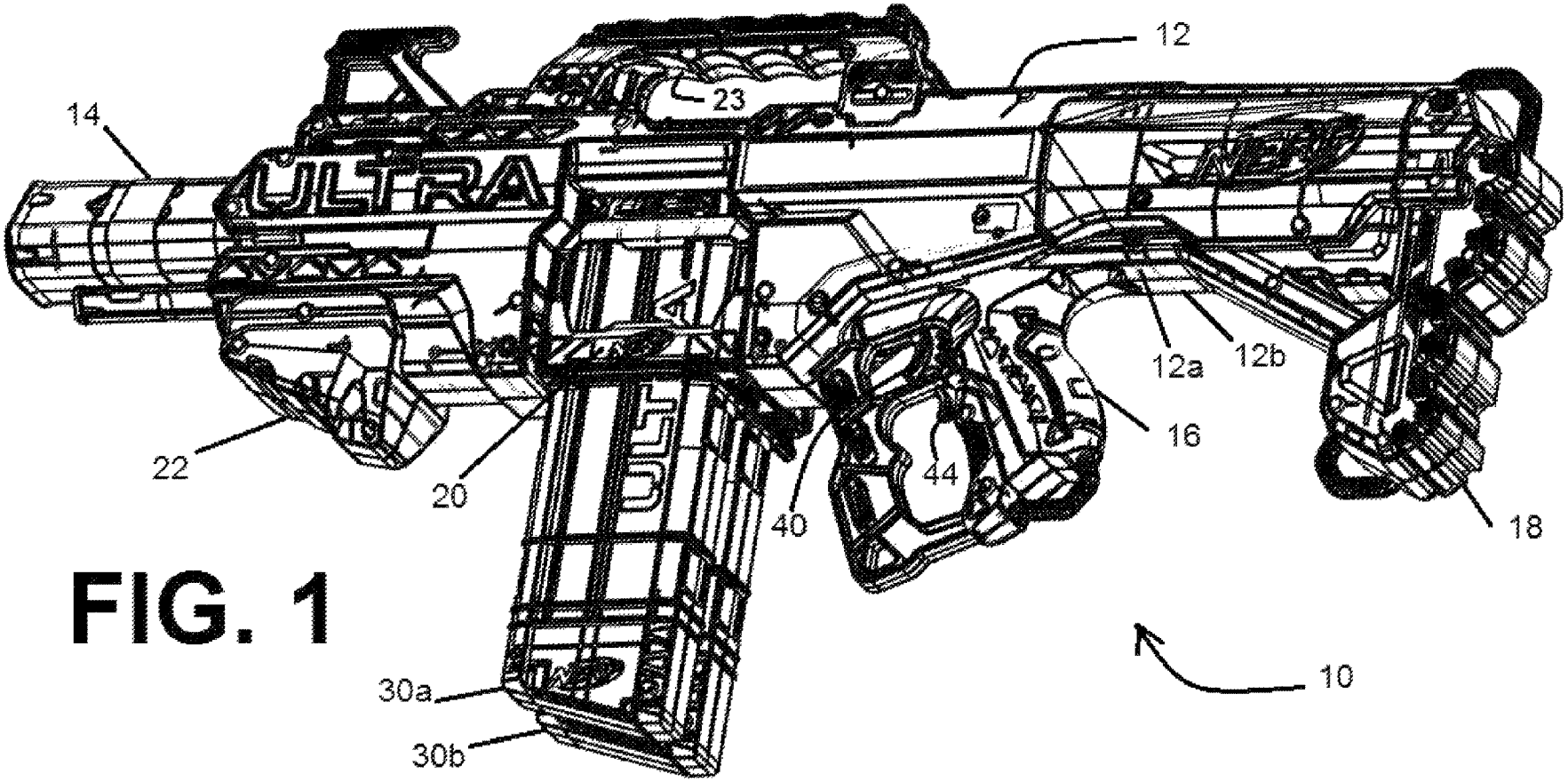
FIG. 1 is a perspective view of a toy launch apparatus having dual triggers and plural or multiple magazine clips inserted into a clips carriage mounted between the forward and rearward ends of the launch apparatus housing in accordance with the present invention.
Figure 2:
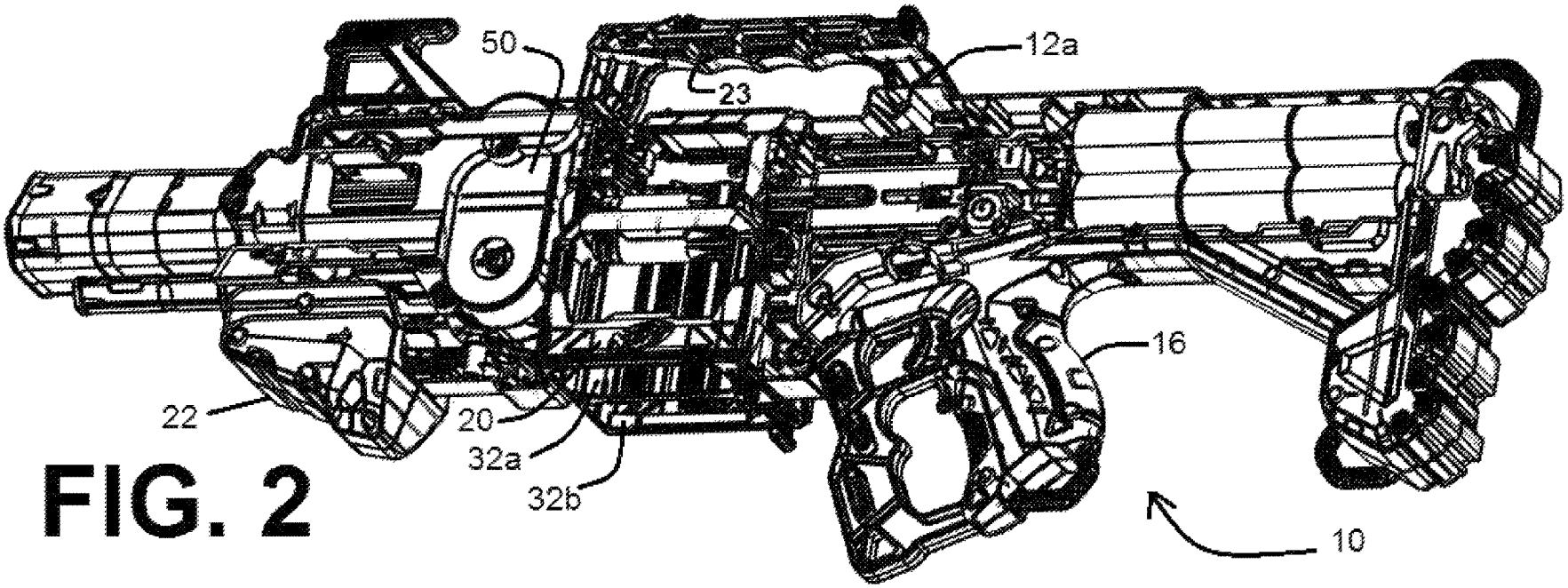
FIG. 2 is a partial interior perspective view partially exposing a propelling mechanism and elongated improvised projectile checking subassembly with a side portion the housing of the launch apparatus removed from FIG. 1 with parts broken away to illustrate the clips carriage and a clips carriage selector for projectiles feeding/magazine storage mechanism with structure for firing projectiles respectively from the magazine clips thereof in accordance with the present invention.
Figure 3:
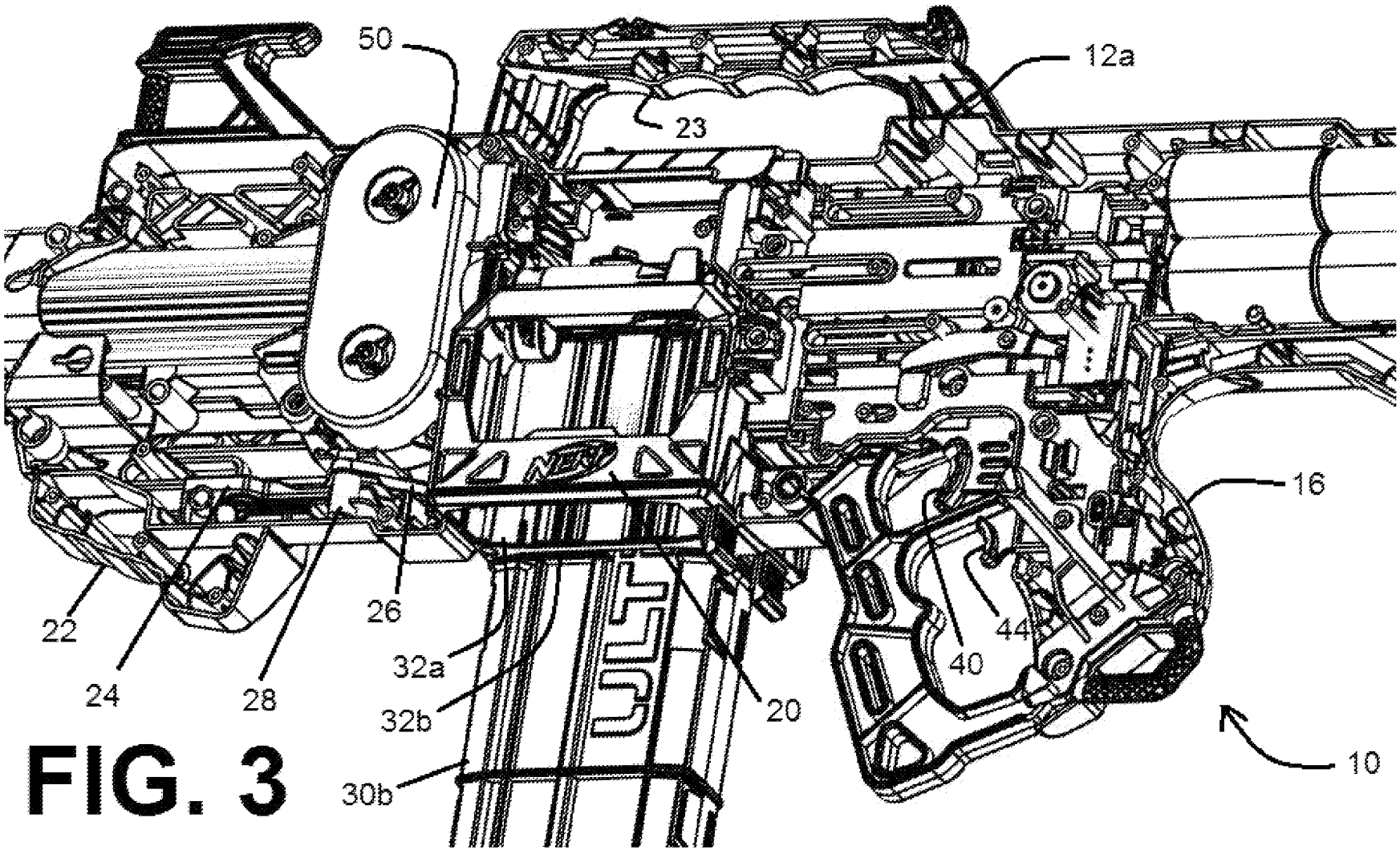
FIG. 3 shows an enlarged partial interior perspective view introducing a first projectile retaining magazine clip into the clips carriage in a first recess of the recesses defined at the lower portion of the clips carriage shown in FIG. 2 as configured for feeding projectiles through an upper portion of the clips carriage where the propelling mechanism in the housing forward said clips carriage receives projectiles individually.
Figure 4:
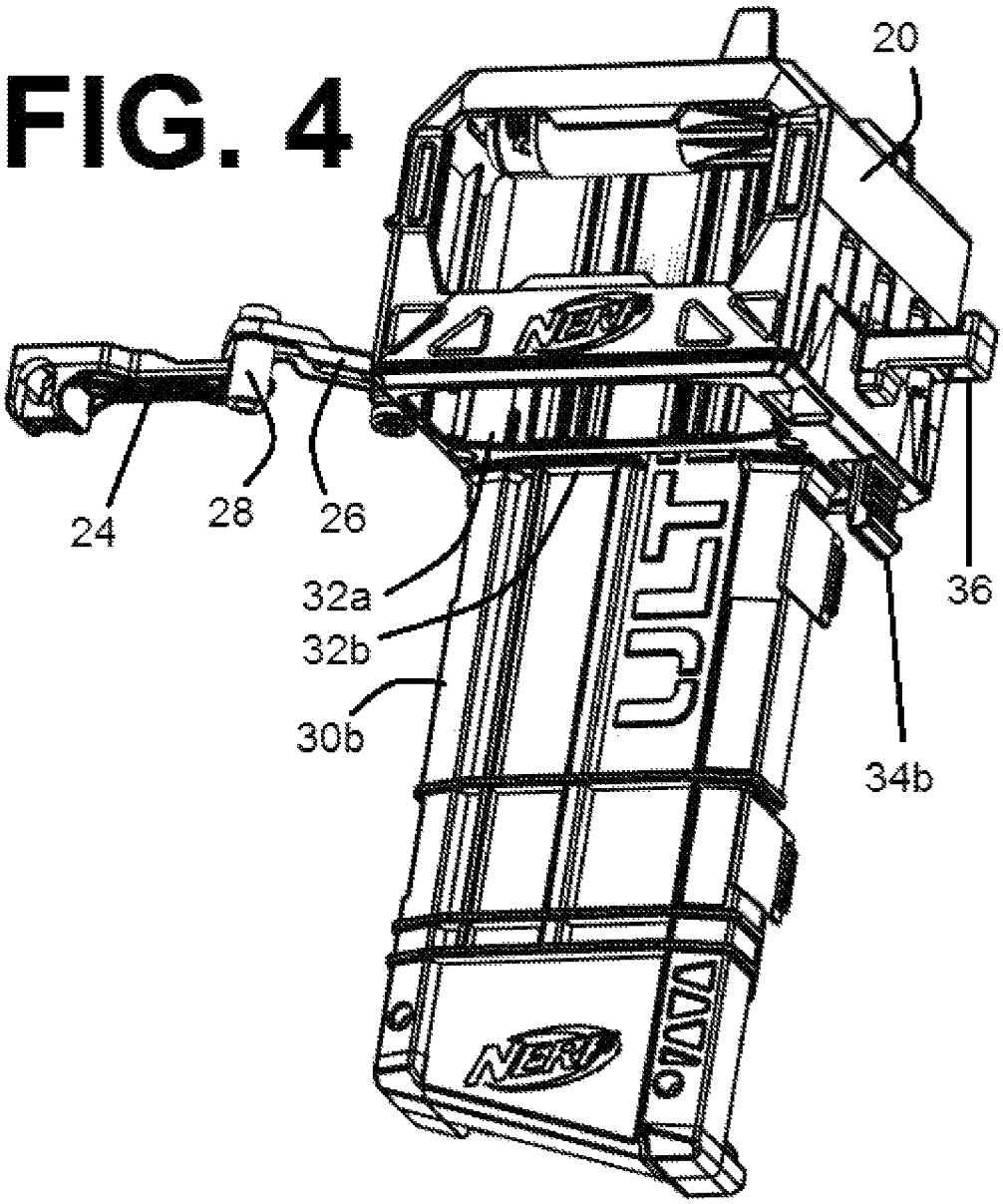
FIG. 4 breaks out the clips carriage from the housing assembly of FIG. 3 showing the first projectile retaining magazine clip with the first and second link connected to the clips carriage as a sub-assembly with the clips carriage having a center rearward proximal extension configured to engage at a center distal extension interlock to the clips carriage in accordance with the present invention.

Referring now to FIGS. 1-3, a toy projectile launcher, gun or blaster launch apparatus 10 is illustrates an embodiment of a dual trigger and plural or multiple magazine toy projectile launcher employing multiple trigger interlock features. The toy launch apparatus 10 has a housing 12 having first and second side portions, and forward and rearward ends thereof including a forward portion with a barrel 14, a grip portion 16 rearward of the barrel 14 and may be provided with a further rearward should rest portion 18 as illustrated in FIGS. 1-2. The housing 12 may be molded in two parts including complementary halves 12*a*, 12*b* provided in elevation as left and right sides of the housing 12. The contents of Applicants' Assignees' U.S. Pat. Nos. 9,097,476 and 9,097,477 to Mead, et al. for "Projectile launcher with rotatable clip connector" illustrates and describes, in detail, toy launcher apparatus with a rotatable clip connector magazine clip alignments with the barrel portion toward spinning flywheels motor assembly for discharge, and is incorporated into the presented disclosure by reference in their entirety. The launch apparatus 10 is further provided with a carriage clip holder or magazine connector clips carriage 20 as illustrated in FIG. 4, such that clips carriage 20 is moveably positioned on the housing 12 shown centrally positioned as illustrated in FIGS. 1-3; however as well be appreciated clips carriage 20 locations may be provided forward or rearward, as well and with the provision of movements laterally thereof as discussed herein. The clips carriage 20 is mounted between the forward and rearward ends of the housing 12 with a lower portion of the clips carriage 20 for receiving first and second projectile retaining magazine clips respectively into first and second recesses defined at the lower portion of the clips carriage 20, each of the first and second projectile retaining magazine clips separately configured for feeding projectiles through an upper portion of the clips carriage 20. FIG. 3 shows an enlarged partial interior perspective view introducing a first projectile retaining magazine clip into the clips carriage in a first recess of the recesses defined at the lower portion of the clips carriage shown in FIG. 2 as configured for feeding projectiles through an upper portion of the clips carriage where the propelling mechanism in the housing forward said clips carriage receives projectiles individually.

As discussed further below, apparatus and methods employ dual triggered feeding of projectiles from the plural or multiple magazine clips with multiple interlock features in a rapid fire toy launcher employing a clips carriage 20 mounted for translatable movement using a carriage selector separately positions clips in line for individual projectile feeding and launch from which a propelling mechanism receives the projectiles from an elongated improvised projectile checking subassembly using a reversible projectile advancing feeder with a gear combination that advances and returns a pusher extension for feeding projectiles through the clips carriage upper portion. The contents of Applicants' Assignees' U.S. Pat. No. 10,907,929 to Bernal for "Toy launch apparatus with multiple improvised projectile checking and locking methods" illustrates and describes, in detail, toy launcher apparatus catch latch recess and catch apertures of elongated structure using an improvised projectile checking spring opening to receive a locking key structure based upon the projectile receiving opening to the improvised projectile checking housing assembly, and is incorporated into the presented disclosure by reference in its entirety. A select grip slide handle 22 clips carriage selector is shown in FIG. 1 at housing 12 for translational movement of the clips carriage 20, below the barrel 14 and forward the clips carriage 20; however as well be appreciated the slide handle 22 may be provided elsewhere upon or within the housing 12 depending on the clips carriage 20 operation, or through alternate manual movement not solely tied to handle 22, as separate manual clips carriage 20 movement or motorized functionality, as discussed herein.

In certain embodiments the toy launch apparatus and methods include a housing assembly and magazine clips loading intermediate with a projectile launching energy generating mechanism in communication with the feeding mechanism forward the inserted clips receiving a series of projectiles therefrom. A Home key is proximal an improvised projectile checking the gear combination verifying orientation at a Home position, with use of the propelling mechanism trigger activating the propelling mechanism key for the propelling mechanism for a reversible projectile advancing feeder to move the gear combination orientation to the Home position, if the gear combination orientation at a non-Home position after which a predetermined period of time disables the propelling mechanism. Thus dual triggered feeding of projectiles from plural or multiple magazine clips with multiple interlock keys facilitate rapid fire toy projectiles launching with the clips carriage mounted for translatable movement using the carriage selector to separately position clips in line for individual projectile feeding and launch.

In further embodiments the propelling mechanism receives projectiles from an elongated improvised projectile checking subassembly using a reversible projectile advancing feeder with a gear combination that advances and returns a pusher extension for feeding projectiles through the clips carriage upper portion. The reversible projectile advancing feeder is positioned in the housing forward the inserted magazine clips. Triggers including a propelling mechanism trigger activates a key and a fire key is activated with a fire trigger, with absence of an appropriate size projectile present at the pusher extension disabling the fire key from activating the reversible projectile advancing motor. Methods employed logically combine the flywheels key, fire key, Home key and the improvised projectile Detect key as inputs to operate the Feeder Motor for firing operations of projectiles. An electronics logic element may use the flywheels switch, fire switch, Home switch and the improvised projectile Detect switch as inputs to operate the Feeder Motor for firing operations of projectiles.

In certain embodiments a motorized Flywheels assembly and the propelling mechanism key may be provided as a first electrical switch activated by the proximal extension of the propelling mechanism trigger. The reversible projectile advancing feeder may be provided as a reversible feeder motor and the Fire key may be provided as a second electrical switch activated by the proximal extension of the elongated Fire trigger. The Home key may be provided as a third electrical switch activated by the reversible projectile advancing feeder with the gear combination orientation at the Home position. The improvised projectile Detect key may be provided as a fourth electrical switch activated by the improvised projectile lock at the catch latch recess. Disclosed embodiments may further employ an information processor logic element that takes the first, second, third and fourth electrical switches as inputs to operate the Feeder Motor for firing operations of projectiles. Briefly summarized the propelling mechanism may be enabled to receive projectiles based on the combination of several keys, with the Home key at the proximal end of the elongated improvised projectile checking subassembly indicating the gear combination orientation with proper conditions, otherwise disabling the propelling mechanism after predetermined period of time expirations.

Figure 5:
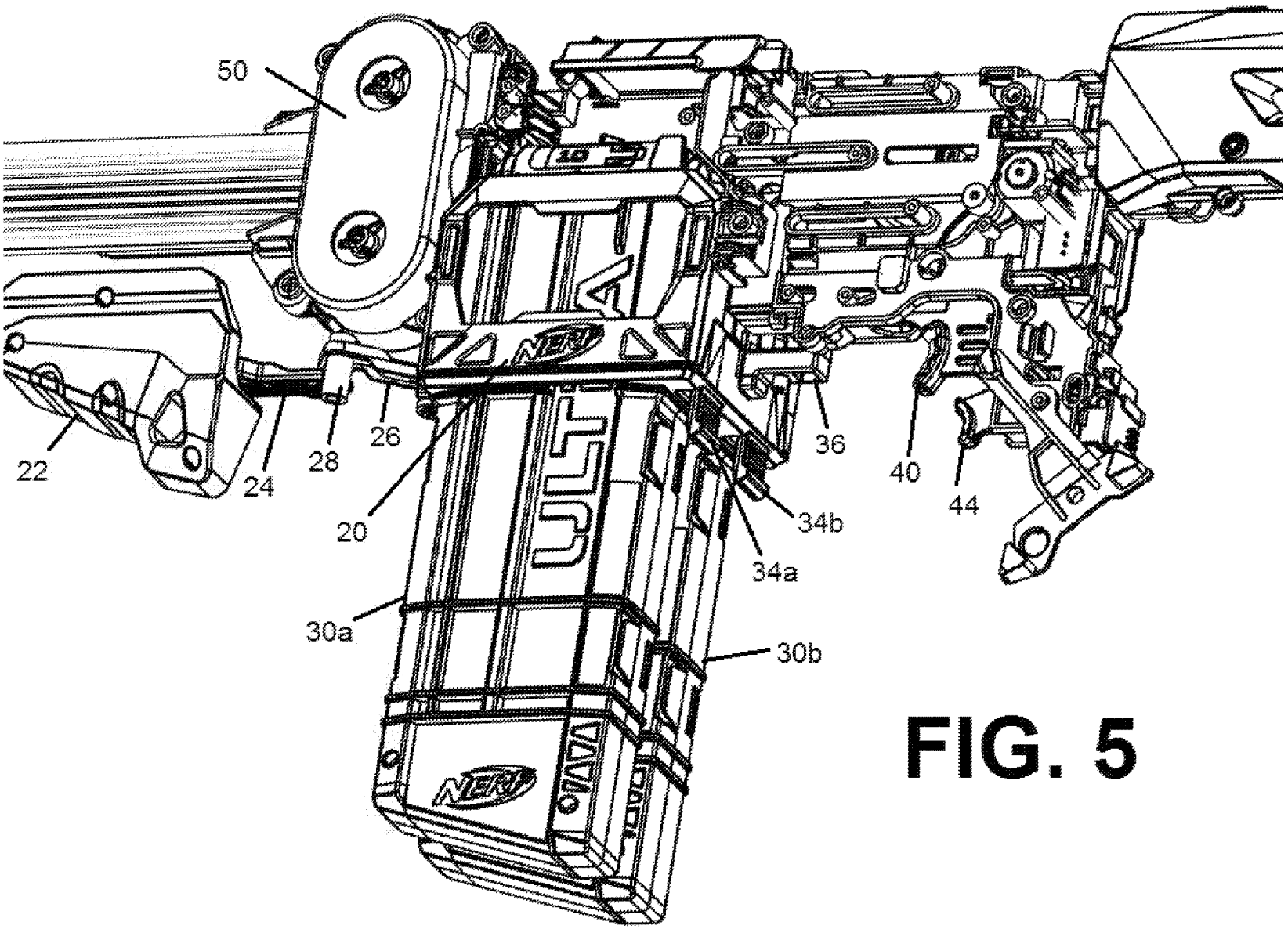
FIG. 5 shows an exposed partial interior perspective view of the propelling mechanism and improvised projectile checking subassemblies for feeding projectiles from inserted first and second projectile retaining magazine clips with related mechanisms in the housing thereof.

As shown with FIGS. 2-4, in the present described embodiment the slide handle 22 operates the clips carriage 20 through a linkage 24 as illustrated in FIGS. 4 and 5, provided as a first link 24 connected to the slide handle 22 and a second link 26 connected to the clips carriage 20 as a sub-assembly with an intermediate pivot pin 28 held captive between the complementary halves 12*a*, 12*b* of the housing 12 as illustrated in FIGS. 2-3. The clips carriage 20 is illustrated in FIGS. 1 and 5 as having received a pair of magazine clips 30*a*, 30*b* in the bottom side of clips carriage 20 provided two or more bottom apertures 32*a*, 32*b* with magazine clips 30*a*, 30*b* maintained in position with tabs 34*a*, 34*b*. A top side housing top handle 23 may be used when handling the launch apparatus 10, and the housing top handle 23 may be used when inserting magazine clips 30*a*, 30*b* at the bottom side of clips carriage 20 into bottom apertures 32*a*, 32*b*. Movement of the slide handle 22 operates the clips carriage 20 sub-assembly for translating movement positioning the received magazine clips 30*a*, 30*b*, with the upper most projectile 31 of an aligned magazine clips 30*a*, 30*b* for being pushed toward the spinning flywheels of the Flywheels assembly 50 motor assembly where energized flywheels propel launch of the projectile 31 away from the launcher apparatus 10. The contents of Applicants' Assignees' U.S. Pat. No. 9,958,230 to Nugent, et al. for "Rapid Fire Toy Launch Apparatus" illustrates and describes, in detail, dart magazine releasing each dart from a toy apparatus magazine simultaneously employing protrusion elements advancing each released dart into an energy generating mechanism for rapidly firing darts controlled by the trigger lever with the transmission link driven additionally for reciprocating motion as long as the micro-switch activates the electric motor, and is incorporated into the presented disclosure by reference in their entirety.

The Flywheels assembly 50 serves as a propelling mechanism in the housing 12 forward the clips carriage 20 for receiving projectiles individually from each of the first and second projectile retaining magazine clips 30*a*, 30*b* and for propelling the received projectiles therefrom. The clips carriage selector slide handle 22 positions one of the first and second projectile retaining magazine clips 30*a*, 30*b* in line with the propelling mechanism Flywheels assembly 50. Alternatively manual user movement clips carriage 20 itself rather than the handle 22 may also achieve clips carriage 20 movement selection, as the user can move the clips back and forth by pushing on the clips carriage 20 itself for clips carriage selector functionality. The reversible projectile advancing feeder discussed below is positioned in the housing forward the inserted magazine clips. Triggers 40, 44 below are operable with a propelling mechanism trigger activates a key and a fire key is activated with a fire trigger driving the projectile-feeding mechanism in a novel fashion for automatic and sequenced projectile-launching operation. In the absence of inserted magazine clips 30*a*, 30*b* the slide handle 22 may nonetheless still operate to translate the clips carriage 20 sub-assembly from side to side.

To better illustrate the clips carriage 20, FIG. 4 breaks out the clips carriage 20. As shown clips carriage 20 has a center rearward proximal extension 36 which is configured to extend rearward and upward configured so as to engage with a clips center distal extension interlock 38 at a forward end of a Fire Key trigger 40 interlocking with the clips carriage rearward proximal extension disabling the elongated Fire trigger when translatable movement of the clips carriage fails to position one of the first and second projectile retaining magazine clips in line with the propelling mechanism. FIG. 4 breaks out the clips carriage from the housing assembly of FIG. 3 showing the first projectile retaining magazine clip with the first and second link connected to the clips carriage as a sub-assembly with the clips carriage having a center rearward proximal extension 36 configured to engage at a center distal extension interlock to the clips carriage. FIG. 5 shows an exposed partial interior perspective view of the propelling mechanism and improvised projectile checking subassemblies for feeding projectiles from inserted first and second projectile retaining magazine clips with related mechanisms.

Figure 6:
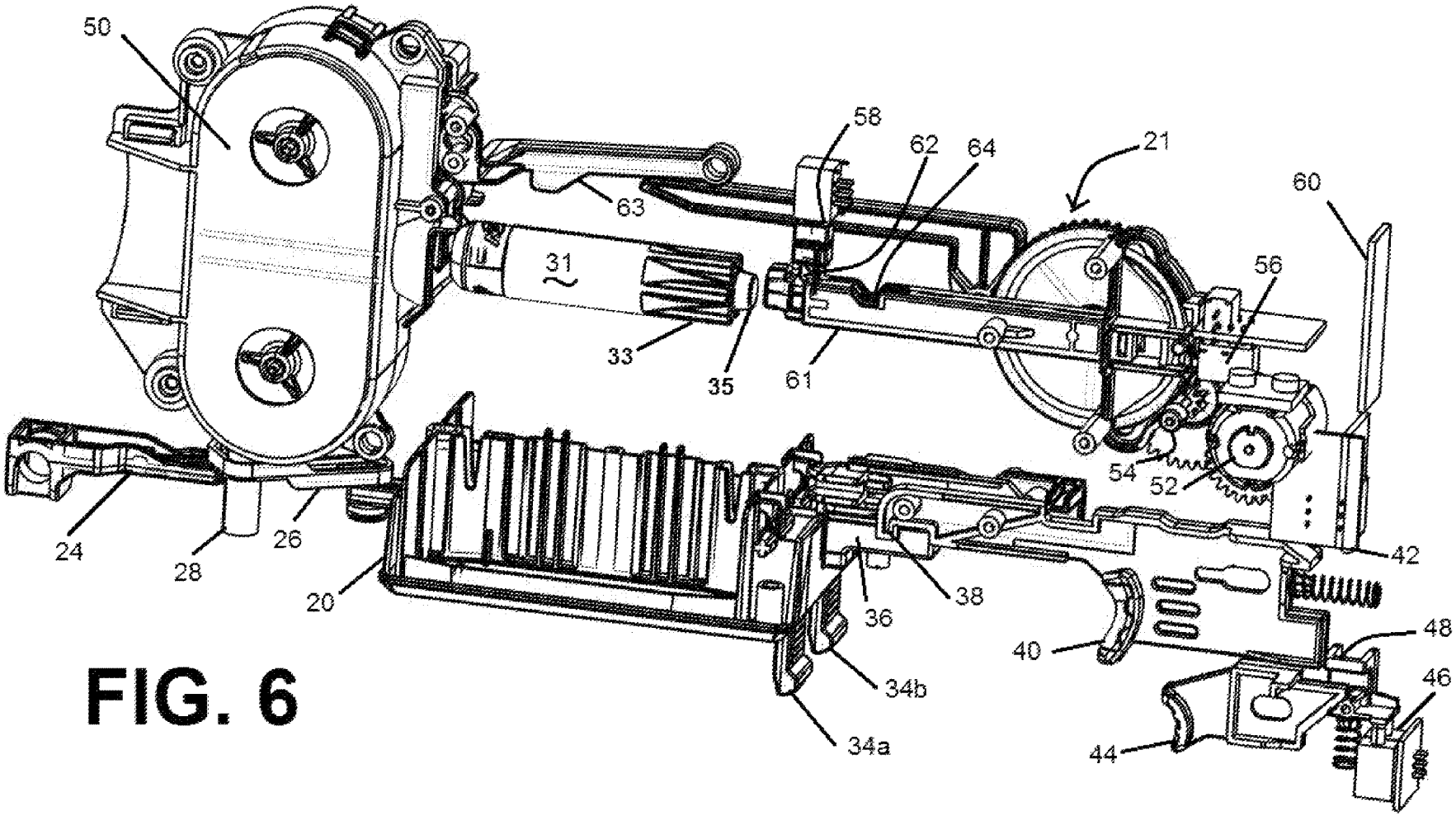
FIG. 6 breaks out the propelling mechanism and elongated improvised projectile checking subassembly including a pusher extension, and reversible projectile advancing feeder with its gear combination for feeding projectiles and firing projectiles from the magazine to the forward launching mechanism in accordance with the present invention.

The Fire Key trigger 40 is operable with a Fire switch 42 and a Flywheel Key trigger 44 (Rev button/Flywheel Key) operable with a Flywheel switch 46 such that use of the Flywheel Key trigger 44 activates the Flywheel switch 46 and a Fire Key trigger interlock 48 at a rearward end of a Fire Key trigger 40. The Flywheel switch 46 acts as a propelling mechanism key in the present embodiment with a first electrical switch activated by the proximal extension of the propelling mechanism trigger, and the Fire switch 42 acts as a Fire key in the present embodiment with a second electrical switch activated by the proximal extension of the elongated Fire trigger. The user may continue to activate a Fire Key trigger 40 until the aligned magazine clips 30*a*, 30*b* are emptied of projectiles 31, or the user may fire a projectile 31, translate the clips carriage 20 and fire again, or the user may fire a few projectiles 31 and then translate the clips carriage 20. Firstly the Flywheel Key trigger 44 may be used at any time to energize the motorized Flywheels assembly 50 prior to launching projectiles in accordance with the rapid fire toy blaster launch apparatus 10 ("Flywheel hold press/release" see coded IC logic element 60 information processing below). Second, then the Fire Key trigger 40 may then operate the Fire switch 42 with the Fire Key trigger interlock 48 clear of the rearward end of the Fire Key trigger 40 ("Fire Key hold press/release" see coded IC logic element 60 information processing below). An interrelationship is provided as between the rearward movement of Flywheel Key trigger 44 that moves the Fire Key trigger interlock 48 element out of the way to enable pullback of the Fire Key trigger 40, as shown in FIG. 6 allowing activation by the proximal extension of the Fire Key trigger 40. The Fire Key trigger 40 is shown as an elongated fire trigger including a proximal extension to a fire key Fire switch 42 for a Feeder Motor 52 herein functioning as a reversible projectile advancing feeder. With the clips center interlock 38 and the Fire Key trigger interlock 48 clear the Fire Key trigger 40 may then close the Fire switch 42 to operate the Feeder Motor 52, and the Fire Key trigger 40 will be free to translate in and out. One or more further mechanical or electronic interlocks may be provided optionally with a projectile jam door or the like in an alternative embodiment where the projectile jam door opening structure may be provided on housing 12 to allow access therein for removing projectiles or dislodging a jammed projectile from the Flywheels assembly 50.

Figure 7:
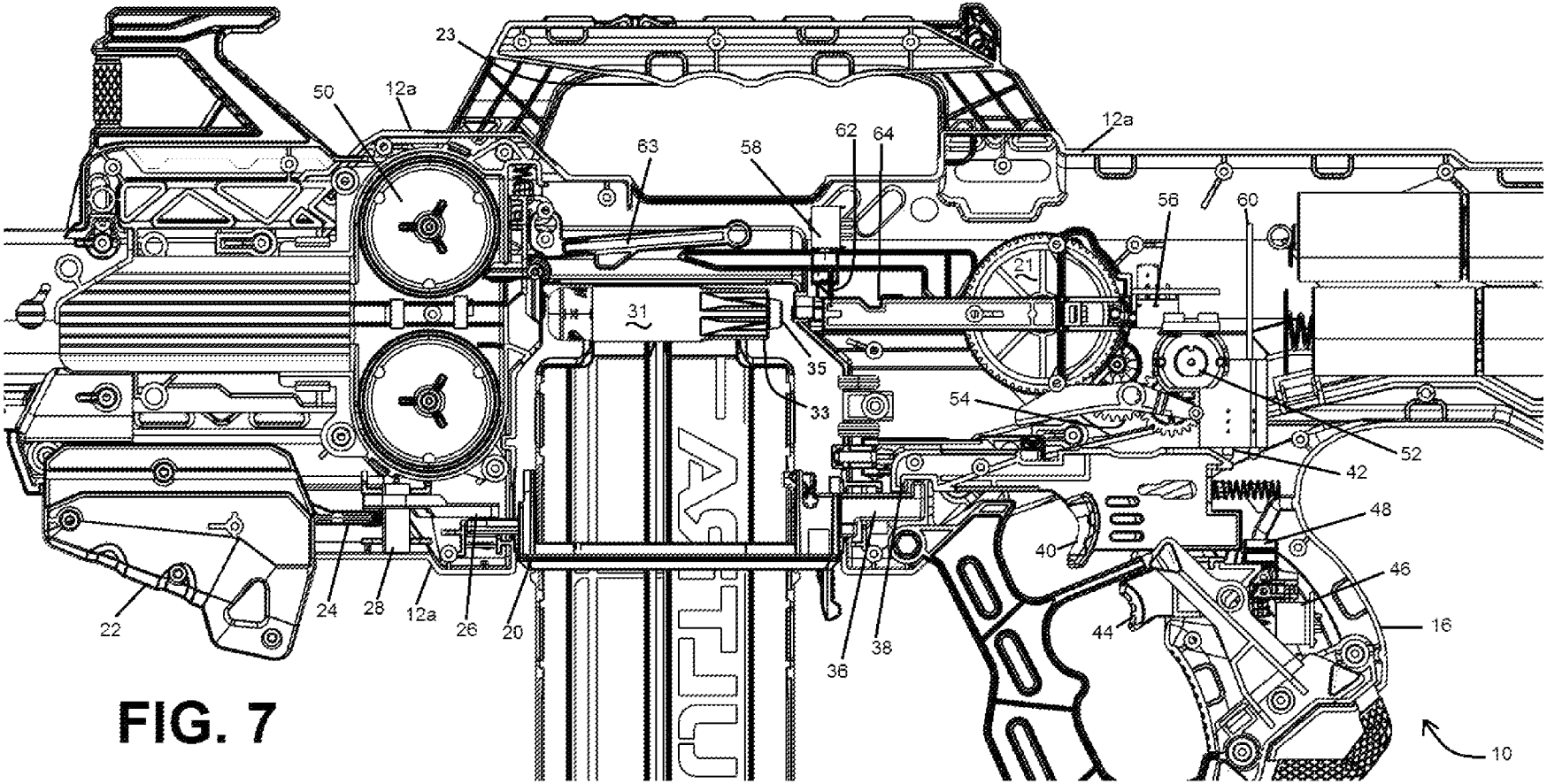
FIG. 7 provides an exposed side elevational dual trigger and plural or multiple magazine launch apparatus with multiple trigger interlocks of the launch apparatus, where a propelling mechanism key includes a first electrical switch activated by the proximal extension of the propelling mechanism trigger, the reversible projectile advancing feeder operates with a Fire key having a second electrical switch activated by the proximal extension of the elongated Fire trigger, where a Home key includes a third electrical switch activated by the reversible projectile advancing feeder with the gear combination orientation at the Home position and the improvised projectile Detect key includes a fourth electrical switch activated by the improvised projectile lock at the catch latch recess in accordance with the present invention.
Figure 8:
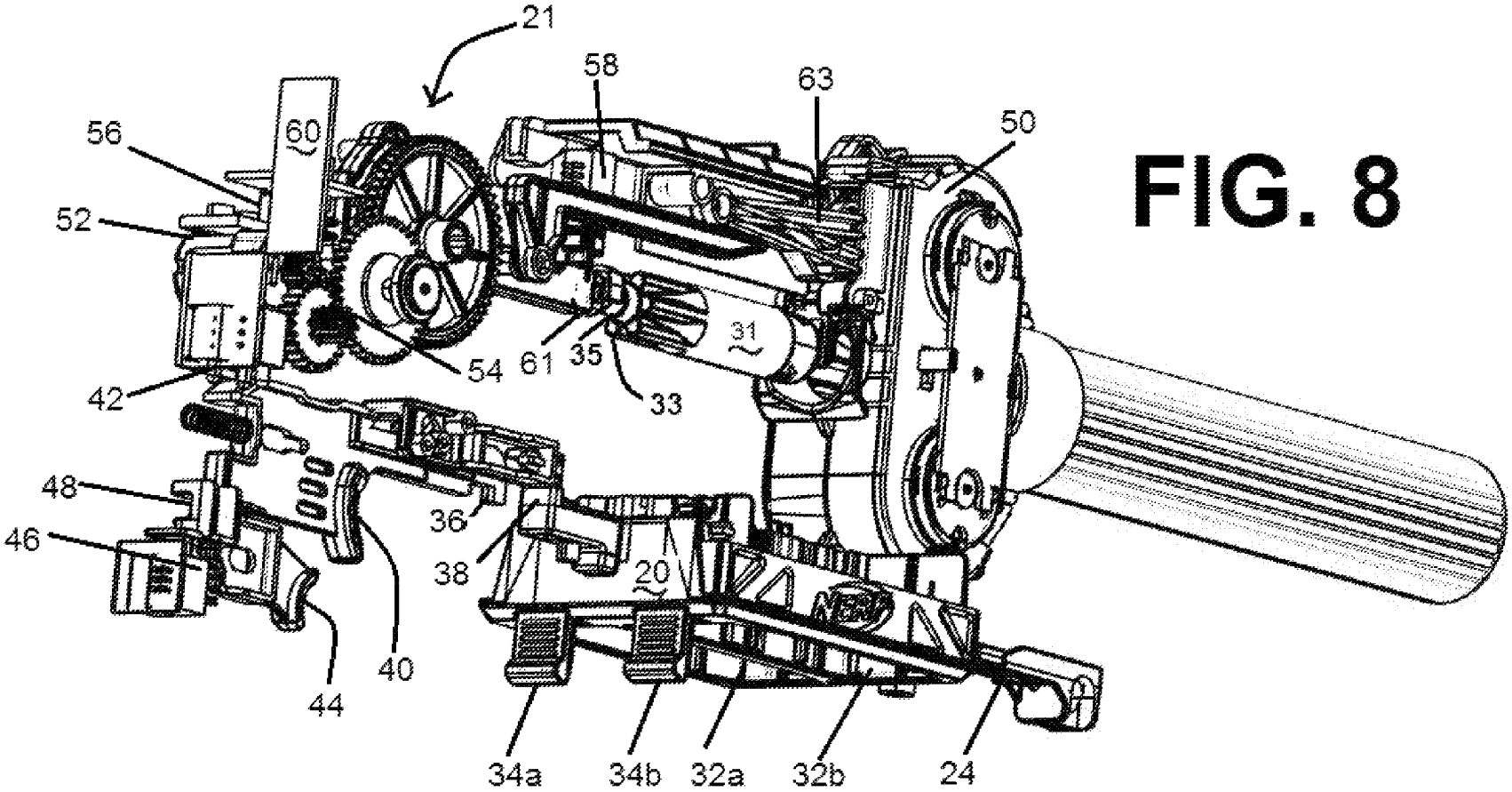
FIG. 8 is a rearward perspective view breaking out the elongated improvised projectile checking subassembly including a pusher extension, and reversible projectile advancing feeder with its gear combination for feeding projectiles and firing projectiles from the magazine to the forward propelling launching mechanism in accordance with the present invention.

With reference to FIGS. 6 through 8, with the Fire Key trigger 40 operating the Fire switch 42, the Feeder Motor 52 is energized with the launch apparatus 10 operation using an elongated improvised projectile checking subassembly 21 with pusher extension structure 61 correspondingly structured and appropriately sized projectiles. FIG. 6 breaks out the propelling mechanism and elongated improvised projectile checking subassembly including a pusher extension 61, and reversible projectile advancing feeder with its gear combination for feeding projectiles and firing projectiles from the magazine to the forward launching mechanism. FIG. 7 provides an exposed side elevational dual trigger and plural or multiple magazine launch apparatus with multiple trigger interlocks. The Feeder Motor 52 facilitates a reversible projectile advancing feeder with a gear combination at a proximal end of the elongated improvised projectile checking subassembly 21 advances and returns its pusher extension 61 for feeding multiple projectiles individually through the upper portion of the clips carriage 20 to the propelling mechanism Flywheels assembly 50.

Such features include requiring the corresponding stepped end 33 and nub 35 present. A step structure surface is used for contacting rearward of stepped fins 33 for detecting offset dual parallel surfaces on backside of the dart at reference numbers 33 and 35. The nub 35 portion of appropriate projectiles extends rearward. For example, the projectile 31 can include a stepped end 33 and a nub 35, such that when the stepped end and nub are present at a projectile receiving opening with any corresponding step, e.g., allowing rearward stepped structure fins 33 portions as discussed for appropriate projectiles at the projectile receiving opening, such that detection checks are triggered. The launch apparatus 10 is constructed for discharging a projectile of predetermined dimensions, and has safety features to prevent other objects from being inserted and discharged. Such acceptable projectiles are shown with projectile 31, having a soft weighted tip portion and rigid light-weight foam body material, including features such as a rearward nub 35. The toy launch apparatus 10 provides the improvised projectile checking subassembly 21 as movable between checking and non-checking positions. The Feeder Motor 52 may be energized to rotate forward and rearward to correspondingly operate a gear combination 54 that advances and returns the improvised projectile checking subassembly 21 as between a dart projectile advancing forward position and a home position. FIG. 7 provides an exposed side elevational dual trigger and plural or multiple magazine launch apparatus 10 with multiple trigger interlocks of the launch apparatus 10, where a propelling mechanism key includes a first electrical switch 42 activated by the proximal extension of the Fire Key trigger 40, the reversible projectile advancing feeder operates with a Fire key having a second electrical switch 46 activated by the proximal extension of the Flywheel Key trigger 44, where a Home key includes a third electrical switch 56 activated by the reversible projectile advancing feeder 52 with the gear combination 54 orientation at the Home position and the improvised projectile Detect key includes a fourth electrical switch 58 activated by the improvised projectile lock 62 at the catch latch recess 64.

A Home Switch 56 is used to determine position as between Home and non-Home positions of the gear combination 54 as operated with Feeder Motor 52. With reference to FIGS. 6 and 7, the improvised projectile lock 62 and catch latch recess 64 facilitates the catch of an IP Dart Detection Key with an IP Detect Switch 58 (IP Key) as a gauge preventing advancing of the projectile forward moveably positioned with the improvised projectile checking subassembly 21 to check the step structure nub 35. At the IP Detect Key Switch 58 the gauge employs a catch latch recess 64 at the elongated improvised projectile checking subassembly, the catch latch recess 64 with an improvised projectile lock 62 and an improvised projectile Detect key at the improvised projectile lock 62 indicating absence of an appropriate size projectile present at the pusher extension 61. If the appropriate projectile is detected, the IP Detect Key Switch 58 communicates with the coded IC logic element 60 information for operating with Feeder Motor 52. The Home Switch 56 acts as a Home key in the present embodiment with a third electrical switch activated by the reversible projectile advancing feeder with the gear combination orientation at the Home position, and the IP Detect Switch 58 acts as a IP Detect key in the present embodiment with a fourth electrical switch activated by the improvised projectile lock 62 at the catch latch recess 64. Also the IP Detect Switch 58 will keep from advancing in absence of a projectile. The step structure of the projectile with the rearward nub 35 at the improvised projectile checking subassembly 21 thus preventing projectiles from being advanced from the end of the elongated improvised projectile checking subassembly 21 structure thus checking the rearward nub 35 discussed ("IP Key keep press/release" see coded IC logic element 60 information processing below). The Home Switch 56 communicates the verified gear combination orientation at the Home position to the coded IC logic element 60 as information for operating the Feeder Motor 52 and pusher extension structure 61.

A programmed firmware or software integrated circuit (IC) is provided as an IC logic element 60 that takes inputs, including the Fire switch 42, Flywheel switch 46, Home Switch 56 and IP Detect Switch 58 with an output of the IC logic element 60 serving as an information processor used to operate the Feeder Motor 52 facilitating single shot as well as full automatic firing operations of projectiles of the discussed projectile 31, while ensuring improvised projectiles and the like are prevented from being advanced with the improvised projectile checking subassembly 21 as discussed for preventing improvised projectiles. The IC logic element 60 acts as an information processor logic element that takes the first, second, third and fourth electrical switches as inputs to operate the Feeder Motor for firing operations of projectiles, and also provides system initiation, testing and operational verifications of launch apparatus 10. In sum, the Home key Home Switch 56 at the proximal end of the elongated improvised projectile checking subassembly indicates the gear combination orientation at its Home position, with use of the propelling mechanism trigger activating the propelling mechanism key for the propelling mechanism for the reversible projectile advancing feeder to move the gear combination orientation to the Home position.

The Flywheel Key trigger 44 activating the Flywheel switch 46 commences operation initially from a system Sleep Mode to first energize the motorized Flywheels assembly 50 prior to launching projectiles as discussed. The propelling mechanism trigger Fire Key trigger 40 with its proximal extension to the propelling mechanism key, has the propelling mechanism trigger proximal extension interlocking the elongated fire trigger proximal extension prior to use of the propelling mechanism trigger activating the propelling mechanism key for the propelling mechanism, with the fire key activating the reversible projectile advancing feeder. At this point, upon power up initialization with the Flywheel switch 46 closed, the IC logic element 60 checks Home Switch 56 to determine whether the gear combination 54 is located in its Home position; otherwise the gear combination 54 is advanced with Feeder Motor 52 until the Home switch 56 is closed to indicate Home position of the gear combination 54, thereupon Normal Play may proceed.

If the IC logic element 60 checking of the Home Switch 56 indicates that the Home switch 56 open, the IC logic element 60 determines that the gear combination 54 is located in a non-Home position. Then a five (5) second time out is provided allowing for the Feeder Motor 52 to advance the gear combination 54 until the Home switch 56 indicates Home position thereof. Upon expiration of the time out failing achieving Home position, the IC logic element 60 overrides operation of the motorized Flywheels assembly 50 with Normal Play is not allowed to proceed and the IC logic element 60 sets the system Sleep Mode, wherein the Home key at the proximal end of the elongated improvised projectile checking subassembly indicating the gear combination orientation at a non-Home position after a predetermined period of time disabling the fire key from activating the reversible projectile advancing motor and the propelling mechanism.

Wake up from the system Sleep Mode thereafter is activated with the Flywheel Key trigger 44 as discussed above to energize the motorized Flywheels assembly 50 with the five (5) second time out allowing for the Feeder Motor 52 to advance the gear combination 54 to its Home position as indicated with the Home switch 56; however recurring expiration would indicate a system error thus not allowing Normal Play to proceed with the IC logic element 60 again setting the system Sleep Mode. Such recurring expiration may indicate an IP Key keep release (indicating, e.g., "No DART or DART jam" see coded IC logic element 60 information processing below).

Figure 9:
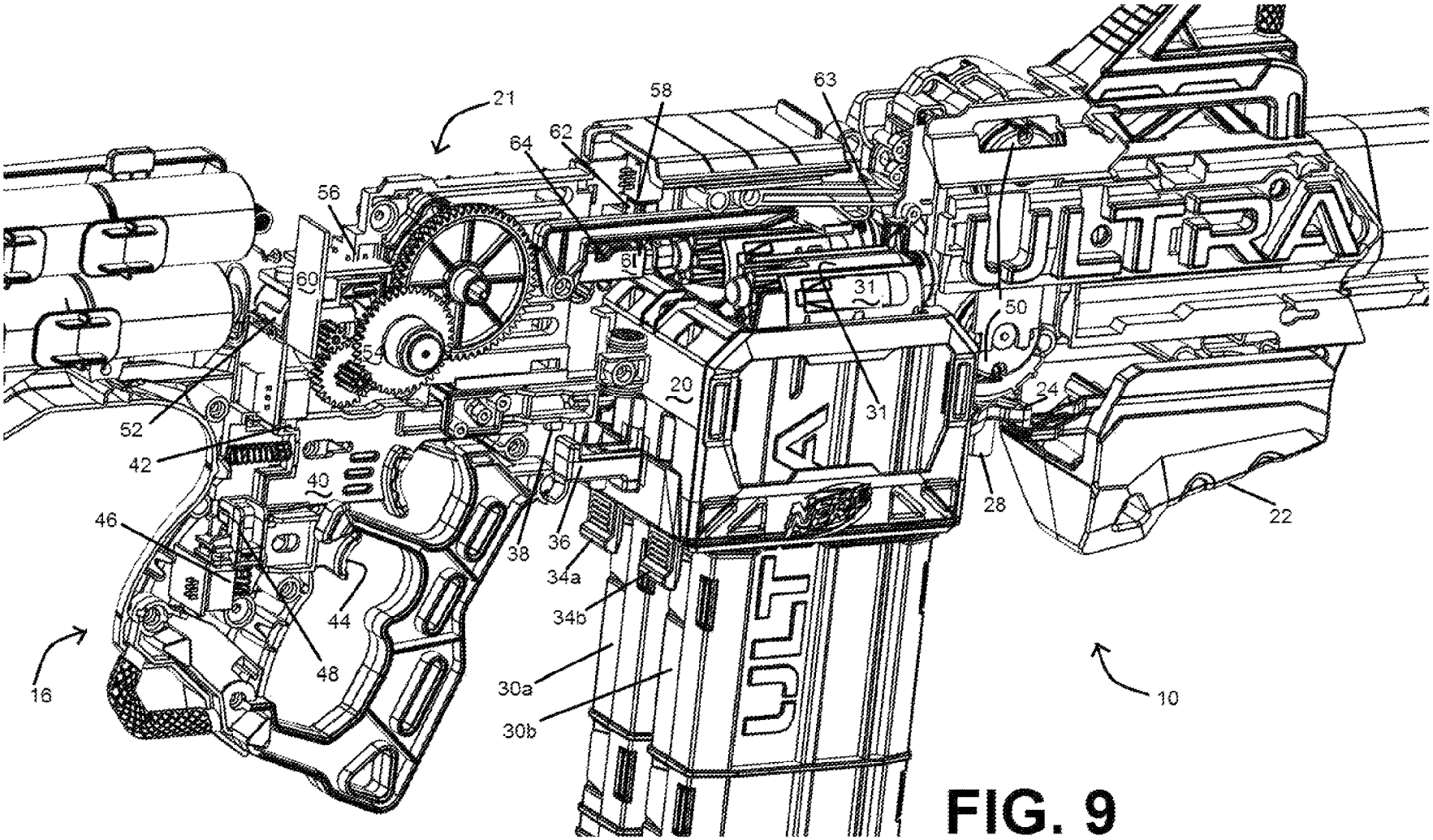
FIG. 9 is a rearward perspective view showing a partial interior perspective view of the improvised projectile checking subassemblies for feeding projectiles from inserted first and second projectile retaining magazine clips shown with related mechanisms including the elongated improvised projectile checking subassembly including a pusher extension, reversible feeder motor and gear combination for feeding projectiles and firing projectiles from the magazine to the forward propelling launching mechanism in accordance with the present invention.

When the Feeder Motor 52 advances the gear combination 54 to its Home position with the Home switch 56 closed, Normal Play proceeds (via coded IC logic element 60 information processing), as follows:

- If Flywheel hold press (and optionally Jam Door Closed if interlock provided above)
  - If Fire key hold press
    - Move Feeder Motor forward and keep check the IP key
      - If IP key keep press
        - Feeder Motor forward
      - Else If IP Key keep release (indicate No DART or DART jam)
- Feeder Motor Backward, Stop when reach Home position, then ignore Fire key hold press until Fire key hold release
  - Else If Fire Key hold release from hold
    - If IP key keep press
      - Feeder Motor Forward, Stop when reach Home position Else If IP Key keep release
Feeder Motor Backward, Stop when reach Home position
Else If Flywheel hold release
Move the Feeder Motor backward until it reaches Home position Accordingly based on the foregoing coded IC logic element 60 information processing, when the Feeder Motor 52 advances the gear combination 54 to the Home position with Normal Play proceeding the IC logic element 60 proceeds to operate the Feeder Motor 52 in sequence for single shot as well as full automatic firing operations of projectiles 31 with the motorized Flywheels assembly 50 energizing the flywheels in sequence with the activated back and forth projectile pusher/feeding mechanism motion from the end of the elongated improvised projectile checking subassembly 21 to advance projectiles 31 one by one to the Flywheels assembly 50. FIG. 8 provides a rearward perspective view breaking out the elongated improvised projectile checking subassembly including a pusher extension 61, and reversible projectile advancing feeder with its gear combination for feeding projectiles and firing projectiles from the magazine to the forward propelling launching mechanism. FIG. 9 is a rearward perspective view showing a partial interior perspective view of the improvised projectile checking subassemblies for feeding projectiles from inserted first and second projectile retaining magazine clips shown with related mechanisms including the elongated improvised projectile checking subassembly including pusher extension 61, reversible feeder motor and gear combination for feeding projectiles and firing projectiles from the magazine to the forward propelling launching mechanism.

Additionally a safety barrier 63 is movably supported in the housing forward the clips carriage for timed operation with the pusher extension 61 of the elongated improvised projectile checking subassembly for individual feeding of projectiles through the upper portion of the clips carriage to the propelling mechanism, with unique driving projectile-feeding advantageous for automatic and sequenced projectile-launching operations based on the combination of several keys, with the Home key at the proximal end of the elongated improvised projectile checking subassembly indicating the gear combination orientation with proper conditions, otherwise disabling the propelling mechanism after predetermined period of time expirations.

As disclosed, the toy dual trigger and plural or multiple magazine launch apparatus with multiple trigger interlock features includes a housing having first and second side portions, and forward and rearward ends thereof. A clips carriage mounted between the forward and rearward ends of the housing with a lower portion of the clips carriage for receiving first and second projectile retaining magazine clips respectively into first and second recesses defined at the lower portion of the clips carriage, each of the first and second projectile retaining magazine clips separately configured for feeding projectiles through an upper portion of the clips carriage. A clips carriage handle at the housing for translational movement of the clips carriage to position one of the first and second projectile retaining magazine clips. A pair of propelling flywheels in the housing forward the clips carriage for receiving projectiles individually from each of the first and second projectile retaining magazine clips and for propelling the received projectiles therefrom. An elongated improvised projectile checking subassembly including a pusher extension, and a reversible projectile advancing motor with a gear combination at a proximal end of the elongated improvised projectile checking subassembly. A flywheels trigger including a proximal extension to a flywheels switch for the pair of propelling flywheels. An elongated fire trigger including a proximal extension to a fire switch for activating the reversible projectile advancing motor, the gear combination of the elongated improvised projectile checking subassembly proximal end having a Home switch to indicate the gear combination orientation at a Home position, wherein the pusher extension advances and returns the pusher extension for feeding multiple projectiles individually through the upper portion of the clips carriage to the pair of propelling flywheels. An improvised projectile lock at the elongated improvised projectile checking subassembly with an improvised projectile Detect switch at the improvised projectile lock. And, an electronics logic element that takes the flywheels switch, fire switch, Home switch and the improvised projectile Detect switch as inputs to operate the Feeder Motor for firing operations of projectiles.

The toy launch apparatus wherein the flywheels trigger proximal extension interlocks the elongated fire trigger proximal extension prior to use of the flywheels trigger activating the flywheels switch for the pair of propelling flywheels, with use of the flywheels trigger activating the flywheels switch for the pair of propelling flywheels for the reversible projectile advancing motor to move the gear combination orientation to the Home position, allowing the fire switch to activate the reversible projectile advancing motor. The toy launch apparatus wherein the improvised projectile lock further includes a catch latch recess for receiving the improvised projectile lock at the elongated improvised projectile checking subassembly indicating absence of an appropriate size projectile present at the pusher extension. The toy launch apparatus includes a rearward proximal extension at the clips carriage with the elongated Fire trigger including a distal extension interlocking with the clips carriage rearward proximal extension disabling the elongated Fire trigger where movement of the clips carriage fails to position one of the first and second projectile retaining magazine clips in line with the pair of propelling flywheels, and a safety barrier movably supported in the housing forward the clips carriage for timed operation with the pusher extension of the elongated improvised projectile checking subassembly for individual feeding of projectiles through the upper portion of the clips carriage to the pair of propelling flywheels.

A dual trigger multiple interlock toy projectile launcher method includes steps of providing a toy projectile launcher housing having first and second side portions, and forward and rearward ends thereof. Mounting a clips carriage between the forward and rearward ends of the housing with a lower portion of the clips carriage for receiving dual first and second projectile retaining magazine clips respectively into first and second recesses defined at the lower portion of the clips carriage, each of the first and second projectile retaining magazine clips separately configured for feeding projectiles through an upper portion of the clips carriage. Moveably disposing a clips carriage handle at the housing for translational movement of the clips carriage to position one of the first and second projectile retaining magazine clips. Coupling a pair of propelling flywheels in the housing forward the clips carriage for receiving projectiles individually from each of the first and second projectile retaining magazine clips and for propelling the received projectiles therefrom. Moveably extending an elongated improvised projectile checking subassembly extending a pusher extension with a reversible projectile advancing motor using a gear combination at a proximal end of the elongated improvised projectile checking subassembly. Attaching a flywheels trigger with a proximal extension to a flywheels key for the pair of propelling flywheels, and attaching an elongated fire trigger with a proximal extension to a fire key for activating the reversible projectile advancing motor, the gear combination of the elongated improvised projectile checking subassembly proximal end having a Home key to indicate the gear combination orientation at a Home position, wherein the pusher extension advances and returns the pusher extension for feeding multiple projectiles individually through the upper portion of the clips carriage to the pair of propelling flywheels; and locking an improvised projectile at the elongated improvised projectile checking subassembly with an improvised projectile Detect key with the improvised projectile locking step.

The toy projectile launcher method further includes the steps of logically combining the flywheels key, fire key, Home key and the improvised projectile Detect key as inputs to operate the Feeder Motor for firing operations of projectiles, wherein the flywheels trigger proximal extension interlocks the elongated fire trigger proximal extension prior to use of the flywheels trigger activating the flywheels key for the pair of propelling flywheels, with use of the flywheels trigger activating the flywheels key for the pair of propelling flywheels for the reversible projectile advancing motor to move the gear combination orientation to the Home position. The toy projectile launcher method where the improvised projectile locking step employs a catch latch recess for locking the improvised projectile at the elongated improvised projectile checking subassembly indicating absence of an appropriate size projectile present at the pusher extension, disabling the fire key from activating the reversible projectile advancing motor.

While a particular embodiment of the present invention has been shown and described, it will be obvious to those skilled in the art that changes and modifications may be made without departing form the invention in its broader aspects. Therefore, the aim in the appended claims is to cover all such changes and modifications as fall within the true spirit and scope to the invention. The matter set forth in the foregoing description and accompanying drawings is offered by way of illustration only and not as a limitation. The actual scope to the invention is intended to be defined on the following claims when viewed in their proper perspective based on the prior art.

What is claimed is:

1. A dual trigger multiple interlock toy projectile launcher apparatus, comprising:

a housing having first and second side portions, and forward and rearward ends thereof;

a clips carriage mounted between the forward and rearward ends of the housing with a lower portion of said clips carriage for receiving first and second projectile retaining magazine clips respectively into first and second recesses defined at the lower portion of said clips carriage, each of the first and second projectile retaining magazine clips separately configured for feeding projectiles through an upper portion of said clips carriage;

a clips carriage handle at the housing for translational movement of said clips carriage to position one of the first and second projectile retaining magazine clips;

a pair of propelling flywheels in the housing forward said clips carriage for receiving projectiles individually from each of the first and second projectile retaining magazine clips and for propelling the received projectiles therefrom;

a reversible projectile advancing motor with a gear combination;

a flywheels trigger including a proximal extension to a flywheels switch for the pair of propelling flywheels; and an elongated fire trigger including a proximal extension to a fire switch for activating the reversible projectile advancing motor, for feeding multiple projectiles individually through the upper portion of said clips carriage to the pair of propelling flywheels for firing operations of projectiles.

2. The toy launch apparatus recited in claim 1, wherein the flywheels trigger proximal extension interlocks the elongated fire trigger proximal extension prior to use of the flywheels trigger activating the flywheels switch for the pair of propelling flywheels, with use of the flywheels trigger activating the flywheels switch for the pair of propelling flywheels for the reversible projectile advancing motor to move the gear combination orientation to a verified position, allowing the fire switch to activate the reversible projectile advancing motor.

3. The toy launch apparatus recited in claim 1, further comprising a rearward proximal extension at said clips carriage with the elongated fire trigger including a distal extension interlocking with the clips carriage rearward proximal extension.

4. The toy launch apparatus recited in claim 1, further comprising:

an elongated improvised projectile checking subassembly including a pusher extension, and the reversible projectile advancing motor with the gear combination at a proximal end of the elongated improvised projectile checking subassembly, the gear combination of the elongated improvised projectile checking subassembly proximal end having a Home switch to indicate the gear combination orientation at a Home position, wherein the pusher extension advances and returns the pusher extension for feeding multiple projectiles individually through the upper portion of said clips carriage to the pair of propelling flywheels;

an improvised projectile lock at the elongated improvised projectile checking subassembly with an improvised projectile Detect switch at the improvised projectile lock, with a catch latch recess for receiving the improvised projectile lock at the elongated improvised projectile checking subassembly indicating absence of an appropriate size projectile present at the pusher extension; and an electronics logic element that takes the flywheels switch, fire switch, Home switch and the improvised projectile Detect switch as inputs to operate the Feeder Motor for firing operations of projectiles.

5. A dual trigger multiple interlock toy projectile launcher apparatus, comprising:

a housing having first and second side portions, and forward and rearward ends thereof;

a clips carriage mounted between the forward and rearward ends of the housing with a lower portion of said clips carriage for receiving first and second projectile retaining magazine clips respectively into first and second recesses defined at the lower portion of said clips carriage, each of the first and second projectile retaining magazine clips separately configured for feeding projectiles through an upper portion of said clips carriage;

a clips carriage selector;

a propelling mechanism in the housing forward said clips carriage for receiving projectiles individually from each of the first and second projectile retaining magazine clips and for propelling the received projectiles therefrom, said clips carriage selector for positioning one of the first and second projectile retaining magazine clips in line with the propelling mechanism;

an elongated improvised projectile checking subassembly including a pusher extension, and a reversible projectile advancing feeder with a gear combination at a proximal end of the elongated improvised projectile checking subassembly that advances and returns the pusher extension for feeding multiple projectiles individually through the upper portion of said clips carriage to the propelling mechanism;

an elongated fire trigger including a proximal extension to a fire key for the reversible projectile advancing feeder, wherein said clips carriage includes a rearward proximal extension and the elongated fire trigger includes a distal extension the distal extension interlocking with the clips carriage proximal extension to disable the elongated fire trigger until said clips carriage positions one of the first and second projectile retaining magazine clips in line with the propelling mechanism; and a propelling mechanism trigger including a proximal extension to a propelling mechanism key for the propelling mechanism, the propelling mechanism trigger proximal extension interlocking the elongated fire trigger proximal extension prior to use of the propelling mechanism trigger activating the propelling mechanism key for the propelling mechanism, the fire key activating the reversible projectile advancing feeder.

6. The toy launch apparatus recited in claim 5, further comprising a Home key at the proximal end of the elongated improvised projectile checking subassembly indicating the gear combination orientation at a Home position, with use of the propelling mechanism trigger activating the propelling mechanism key for the propelling mechanism for the reversible projectile advancing feeder to move the gear combination orientation to the Home position.

7. The toy launch apparatus recited in claim 6, wherein the Home key at the proximal end of the elongated improvised projectile checking subassembly indicating the gear combination orientation at a non-Home position after a predetermined period of time disables the propelling mechanism.

8. The toy launch apparatus recited in claim 6, further comprising a catch latch recess at the elongated improvised projectile checking subassembly, the catch latch recess with an improvised projectile lock and an improvised projectile Detect key at the improvised projectile lock indicating absence of an appropriate size projectile present at the pusher extension.

9. The toy launch apparatus recited in claim 5, further comprising a safety barrier movably supported in the housing forward said clips carriage for timed operation with the pusher extension of the elongated improvised projectile checking subassembly for individual feeding of projectiles through the upper portion of said clips carriage to the propelling mechanism.

10. The toy launch apparatus recited in claim 8, wherein said propelling mechanism comprises a motorized Flywheels assembly and said propelling mechanism key comprises a first electrical switch activated by the proximal extension of the propelling mechanism trigger.

11. The toy launch apparatus recited in claim 10, wherein said reversible projectile advancing feeder comprises a reversible feeder motor and said fire key comprises a second electrical switch activated by the proximal extension of the elongated fire trigger.

12. The toy launch apparatus recited in claim 11, wherein said Home key comprises a third electrical switch activated by the reversible projectile advancing feeder with the gear combination orientation at the Home position.

13. The toy launch apparatus recited in claim 12, wherein said improvised projectile Detect key comprises a fourth electrical switch activated by the improvised projectile lock at the catch latch recess.

14. The toy launch apparatus recited in claim 13, further comprises an information processor logic element that takes the first, second, third and fourth electrical switches as inputs to operate the Feeder Motor for firing operations of projectiles.

15. The toy launch apparatus recited in claim 14, wherein the Home key at the proximal end of the elongated improvised projectile checking subassembly indicating the gear combination orientation at a non-Home position after a predetermined period of time disables the propelling mechanism.

16. A dual trigger multiple interlock toy projectile launcher method, comprising the steps of:

providing a toy projectile launcher housing having first and second side portions, and forward and rearward ends thereof;

mounting a clips carriage between the forward and rearward ends of the housing with a lower portion of said clips carriage for receiving first and second projectile retaining magazine clips respectively into first and second recesses defined at the lower portion of the clips carriage, each of the first and second projectile retaining magazine clips separately configured for feeding projectiles through an upper portion of the clips carriage;

moveably disposing a clips carriage handle at the housing for translational movement of the clips carriage to position one of the first and second projectile retaining magazine clips;

coupling a pair of propelling flywheels in the housing forward the clips carriage for receiving projectiles individually from each of the first and second projectile retaining magazine clips and for propelling the received projectiles therefrom;

moveably extending an elongated improvised projectile checking subassembly extending a pusher extension with a reversible projectile advancing motor using a gear combination at a proximal end of the elongated improvised projectile checking subassembly;

attaching a flywheels trigger with a proximal extension to a flywheels key for the pair of propelling flywheels;

attaching an elongated fire trigger with a proximal extension to a fire key for activating the reversible projectile advancing motor, the gear combination of the elongated improvised projectile checking subassembly proximal end having a Home key to indicate the gear combination orientation at a Home position, wherein the pusher extension advances and returns the pusher extension for feeding multiple projectiles individually through the upper portion of the clips carriage to the pair of propelling flywheels; and locking an improvised projectile at the elongated improvised projectile checking subassembly with an improvised projectile Detect key with the improvised projectile locking step.

17. The toy projectile launcher method recited in claim 16, comprising the step of logically combining the flywheels key, fire key, Home key and the improvised projectile Detect key as inputs to operate the Feeder Motor for firing operations of projectiles, wherein the flywheels trigger proximal extension interlocks the elongated fire trigger proximal extension prior to use of the flywheels trigger activating the flywheels key for the pair of propelling flywheels, with use of the flywheels trigger activating the flywheels key for the pair of propelling flywheels for the reversible projectile advancing motor to move the gear combination orientation to the Home position.

18. The toy projectile launcher method recited in claim 16, wherein the improvised projectile locking step employs a catch latch recess for locking the improvised projectile at the elongated improvised projectile checking subassembly indicating absence of an appropriate size projectile present at the pusher extension, disabling the fire key from activating the reversible projectile advancing motor.

* * * * *